US011691409B2

(12) United States Patent
Vernay

(10) Patent No.: US 11,691,409 B2
(45) Date of Patent: Jul. 4, 2023

(54) HANDLING CARRIAGE FOR THE CYLINDER OF A PRINTING UNIT IN A PRINTING MACHINE

(71) Applicant: Bobst Lyon, Villeurbanne (FR)

(72) Inventor: Eric Vernay, Orlienas (FR)

(73) Assignee: Bobst Lyon, Villeurbanne (FR)

( * ) Notice: Subject to any disclaimer, the term of this patent is extended or adjusted under 35 U.S.C. 154(b) by 0 days.

(21) Appl. No.: 17/424,472

(22) PCT Filed: Feb. 19, 2020

(86) PCT No.: PCT/EP2020/025078
§ 371 (c)(1),
(2) Date: Jul. 20, 2021

(87) PCT Pub. No.: WO2020/169256
PCT Pub. Date: Aug. 27, 2020

(65) Prior Publication Data

US 2022/0072845 A1 Mar. 10, 2022

(30) Foreign Application Priority Data

Feb. 20, 2019 (FR) ..... 1901692

(51) Int. Cl.
*B41F 13/34* (2006.01)
*B41F 5/24* (2006.01)
*B41F 13/00* (2006.01)

(52) U.S. Cl.
CPC ..... *B41F 13/34* (2013.01); *B41F 5/24* (2013.01); *B41F 13/0008* (2013.01)

(58) Field of Classification Search
CPC ..... B41P 2213/80; B41P 2213/804; B41F 13/0016; B41F 13/34; B41F 5/24; B41F 13/0008
See application file for complete search history.

(56) References Cited

U.S. PATENT DOCUMENTS 5,275,105 A 1/1994 Schweizer et al.
7,117,789 B2 * 10/2006 Bazin ..... B41F 13/34 101/153

(Continued)

FOREIGN PATENT DOCUMENTS

CN 1292325 A 4/2001
CN 106414075 A 2/2017

(Continued)

OTHER PUBLICATIONS

International Search Report dated Jun. 24, 2020 in counterpart International Patent Application No. PCT/EP2020/025078 (3 pages in English, 4 pages in French).

*Primary Examiner* — Matthew G Marini
*Assistant Examiner* — Leo T Hinze
(74) *Attorney, Agent, or Firm* — Bookoff McAndrews, PLLC

(57) ABSTRACT

The invention relates to a mobile handling carriage (9) for handling a rotary roll (10) in a printing unit (2), including: a mobile chassis (90); a support member (91) for supporting the roll (10); a first drive device (902) configured to drive the support member (91) in translation in a vertical direction; an actuator (92) mounted on the support member (91) and configured to collaborate with the roll (10) positioned a distance above the support member (91); a second drive device (910) configured to drive the actuator (92) in translation in a longitudinal direction; a control circuit configured to control a first sequence including, in succession: a raising of the support member (91); a longitudinal translation of the support member (91) in a first direction; a lowering of the support member (91); a longitudinal translation of the actuator in the first direction.

20 Claims, 14 Drawing Sheets

(56) References Cited

U.S. PATENT DOCUMENTS

| | | | | |
|---|---|---|---|---|
| 9,056,451 | B2 * | 6/2015 | Rogge | B41F 13/0016 |
| 2004/0182271 | A1 | 9/2004 | Bazin | |

FOREIGN PATENT DOCUMENTS

| | | | |
|---|---|---|---|
| EP | 1092536 | A1 | 4/2001 |
| EP | 1464490 | A1 | 10/2004 |
| FR | 2718995 | A1 | 9/1997 |
| JP | H05-154998 | A | 6/1993 |
| JP | H07-032576 | A | 2/1995 |
| JP | H09-239949 | A | 9/1997 |
| JP | 2018-089933 | A | 6/2018 |
| WO | 2018105518 | A1 | 6/2018 |

* cited by examiner

[Fig. 1]
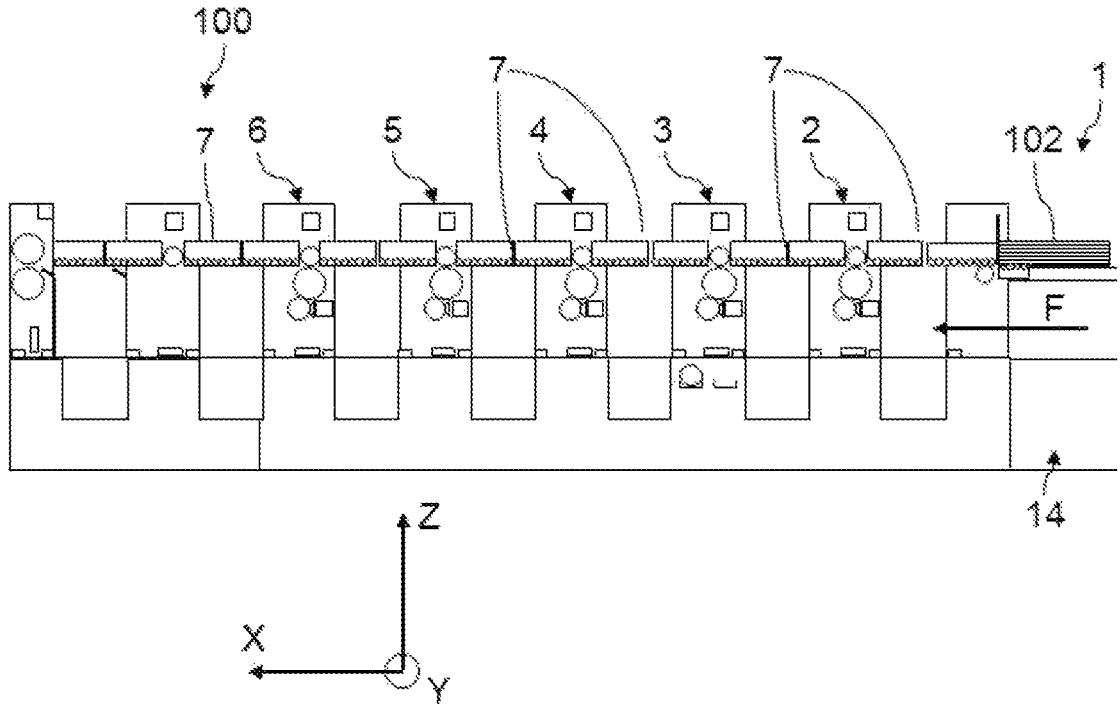

[Fig. 2]
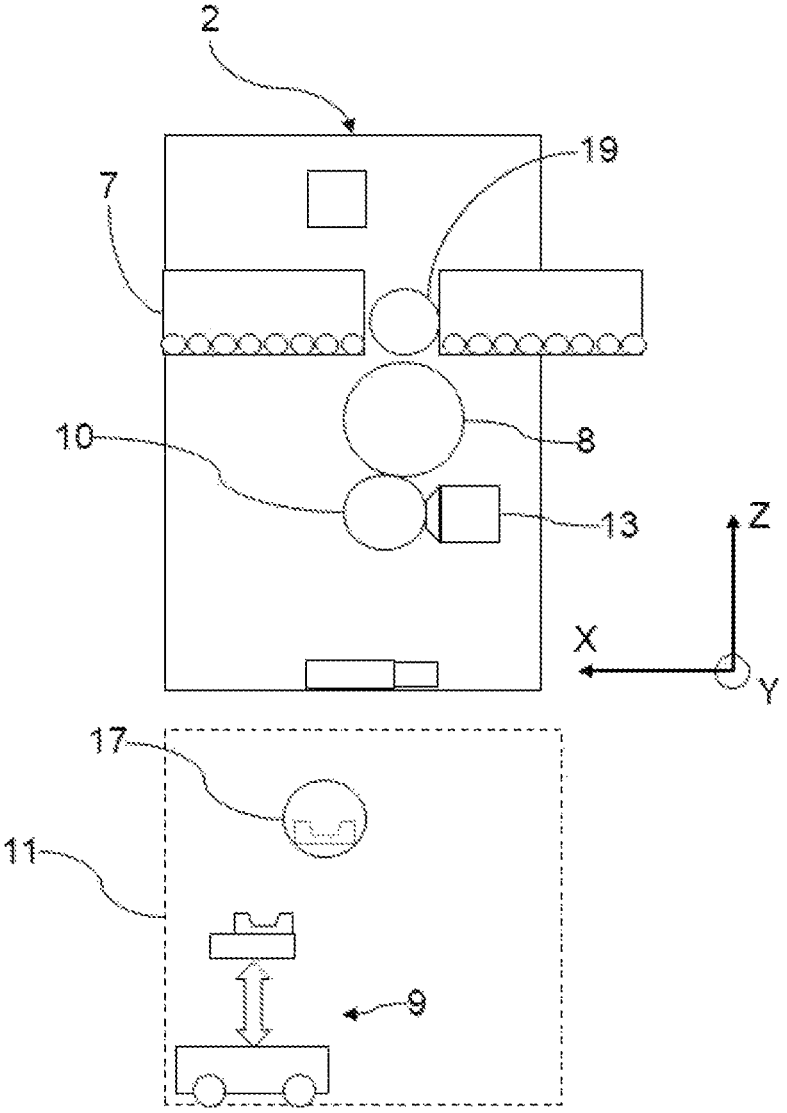

[Fig. 3]
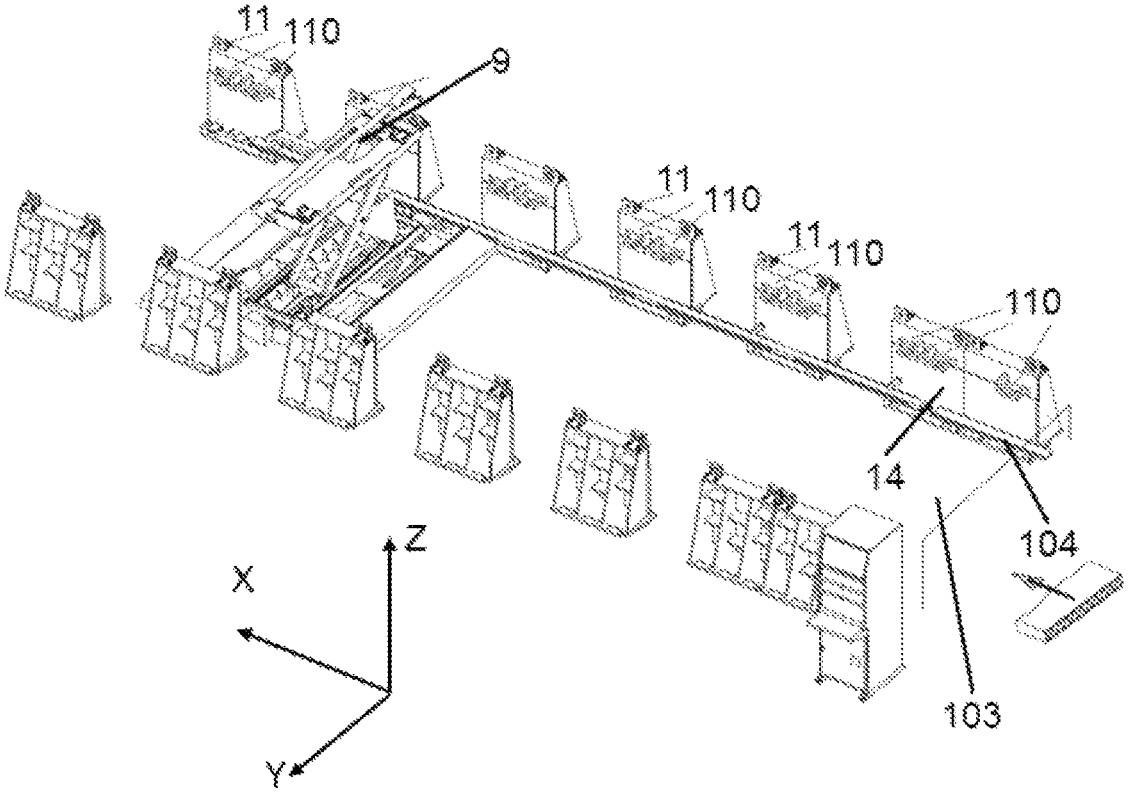

[Fig. 4]
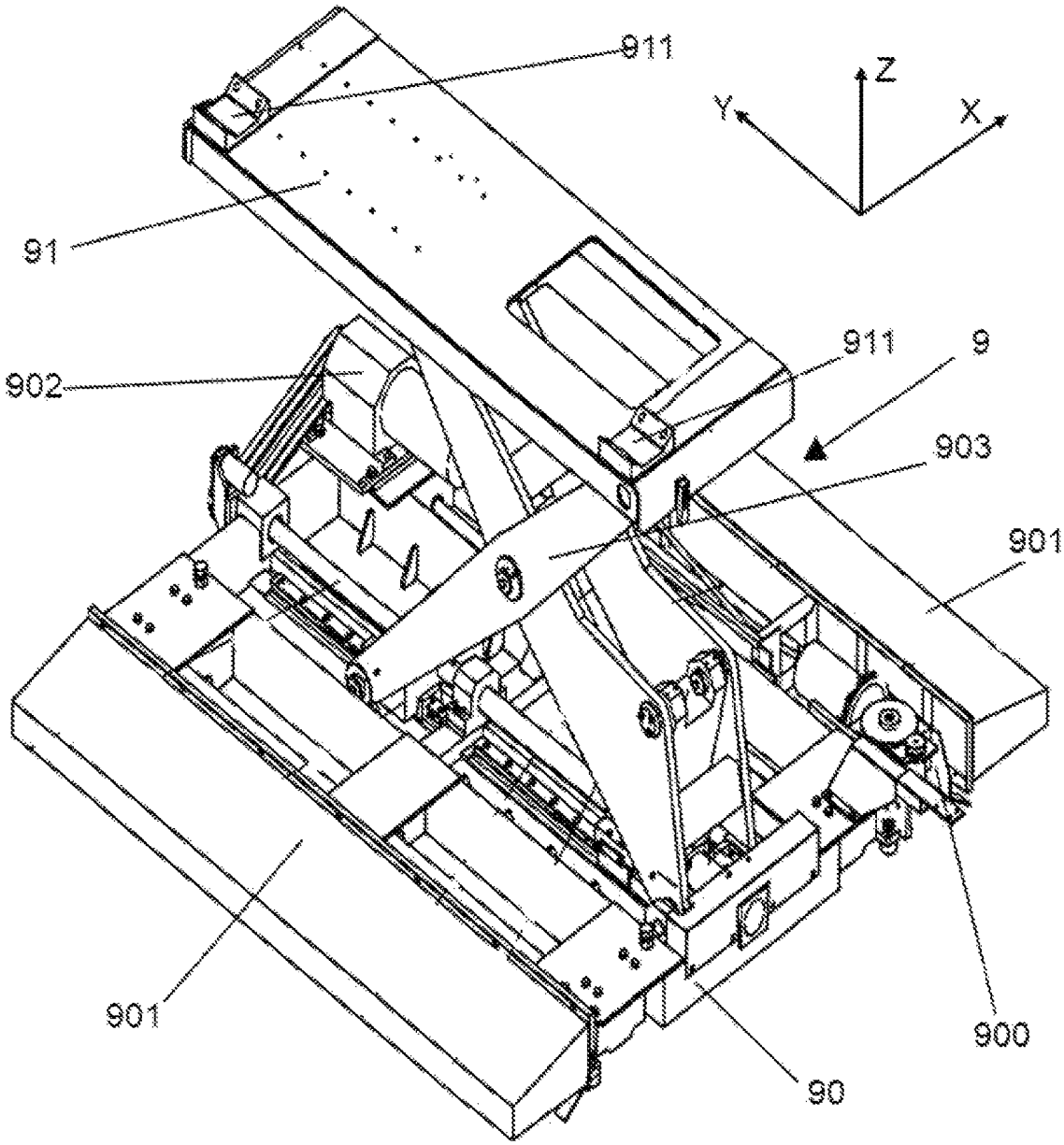

[Fig. 5]
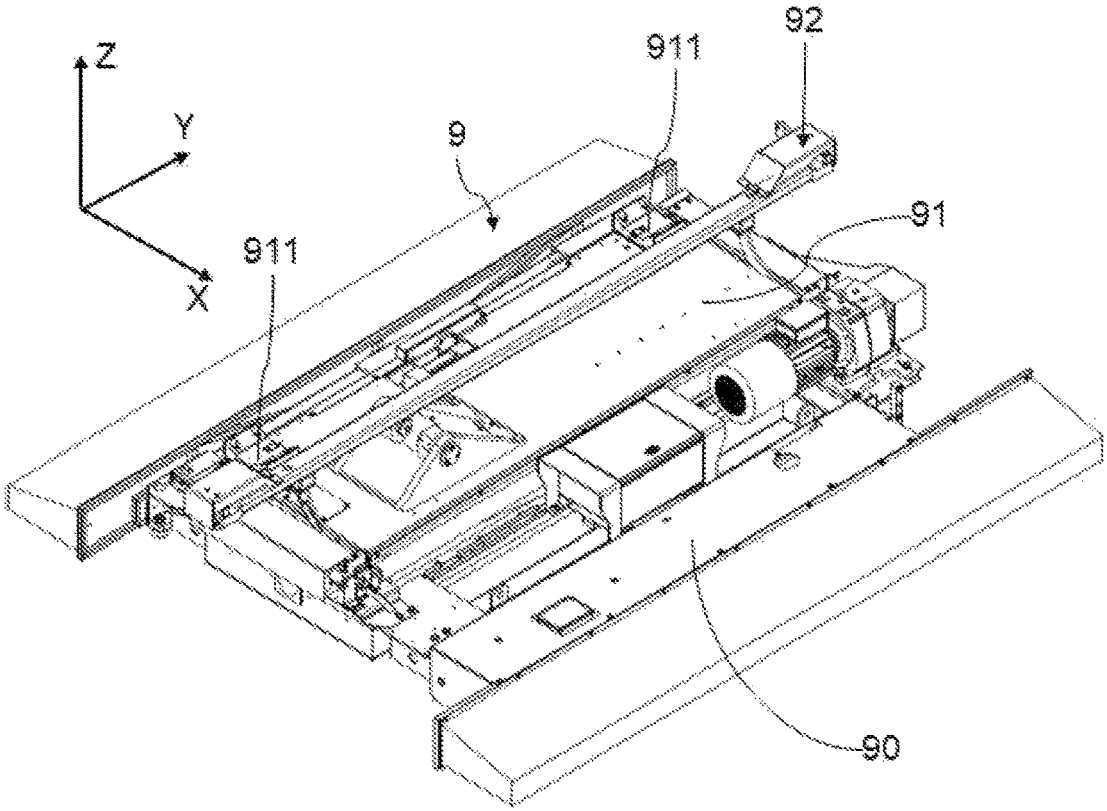
[Fig. 6]
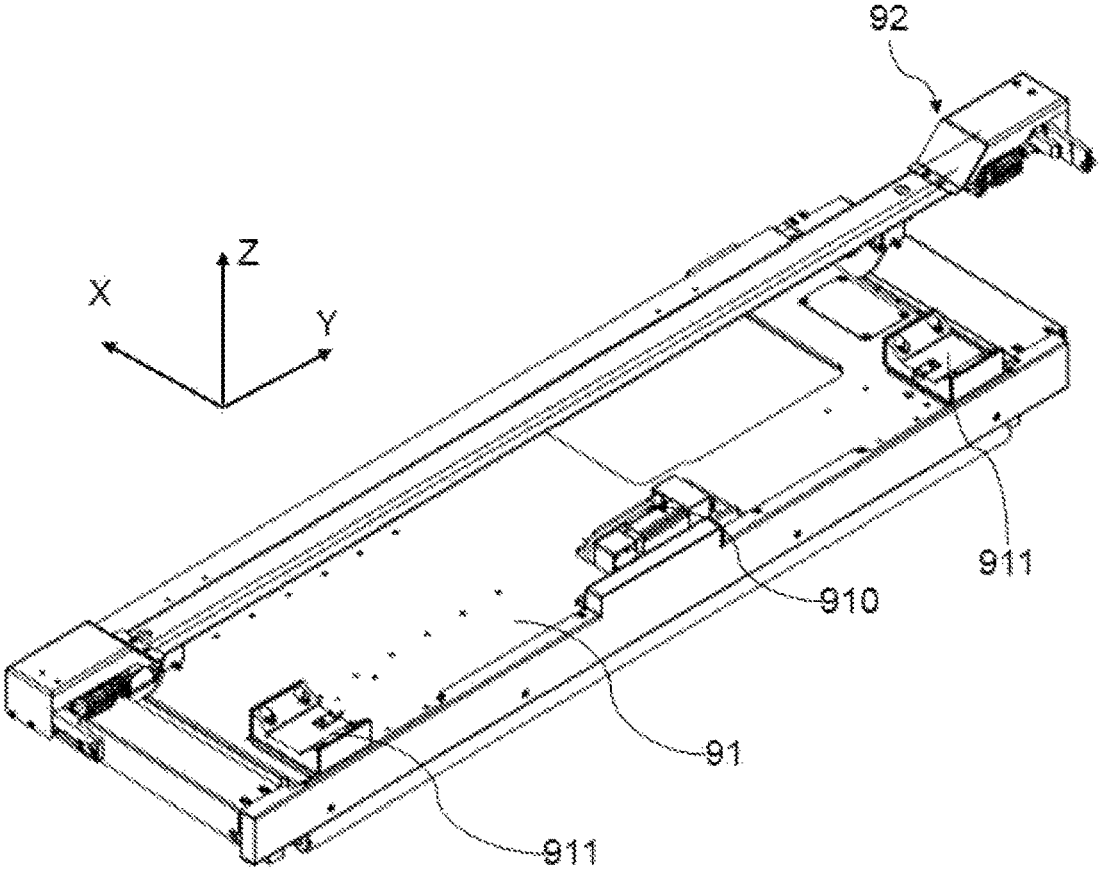

[Fig. 7]
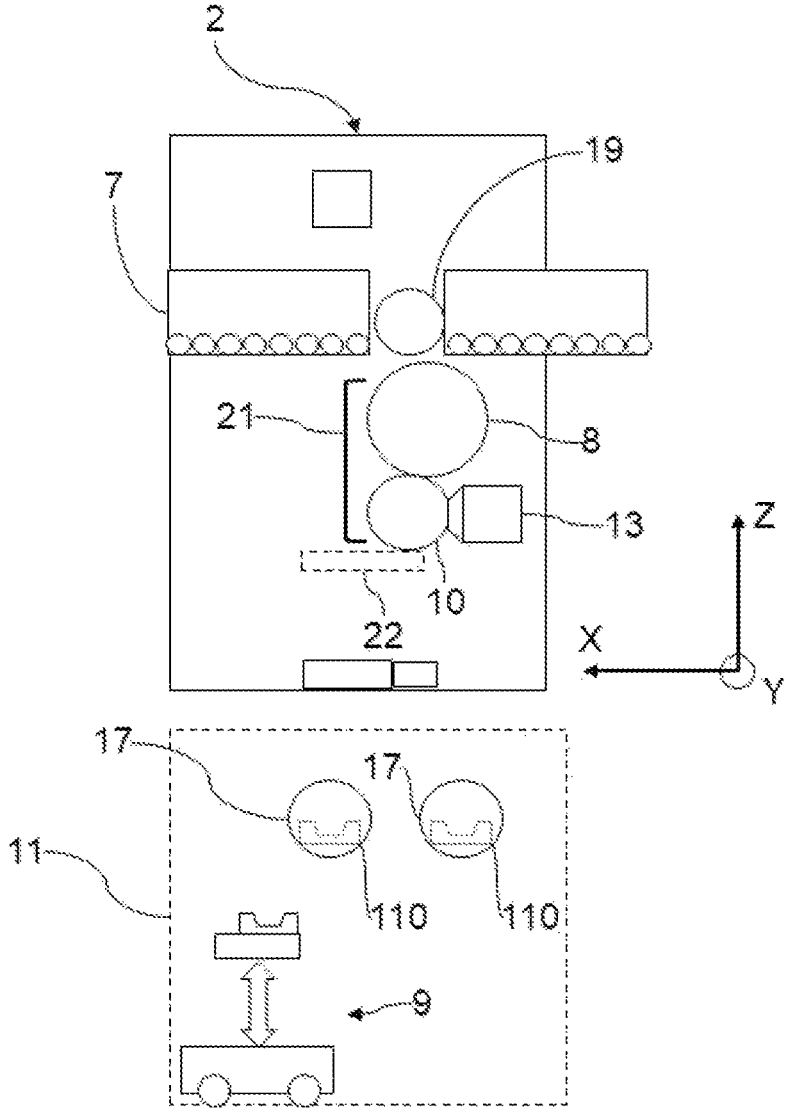

[Fig. 8]
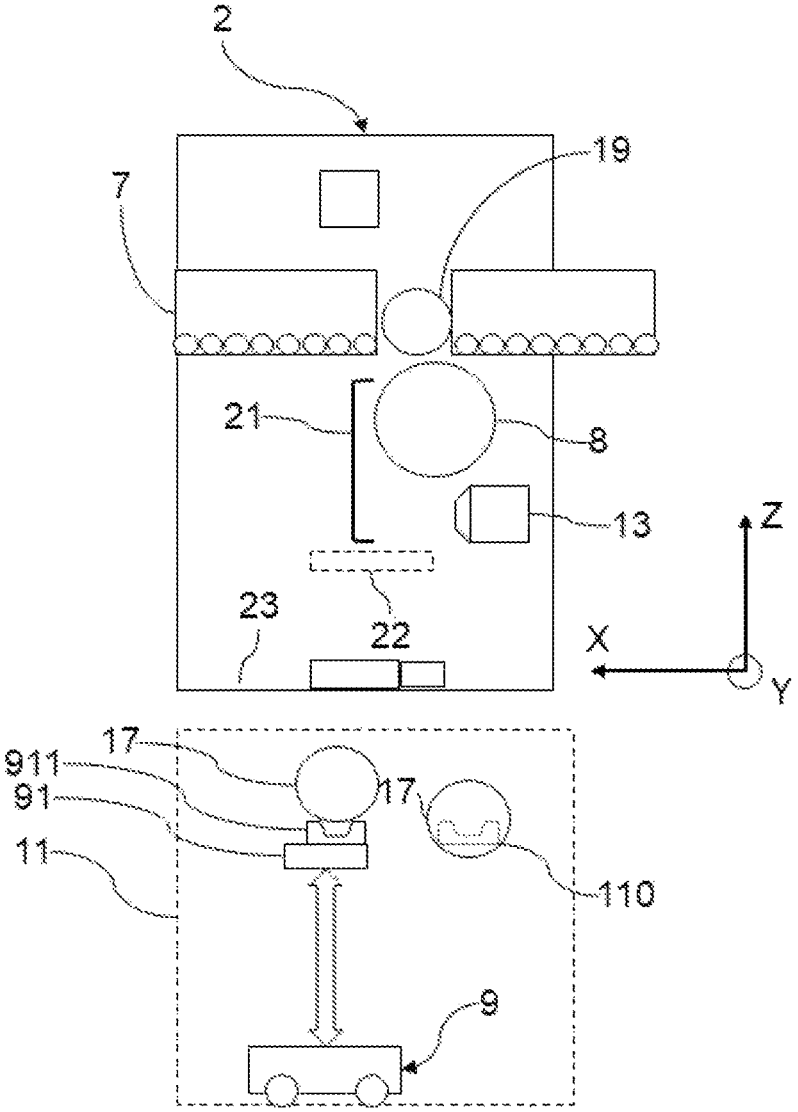

[Fig. 9]
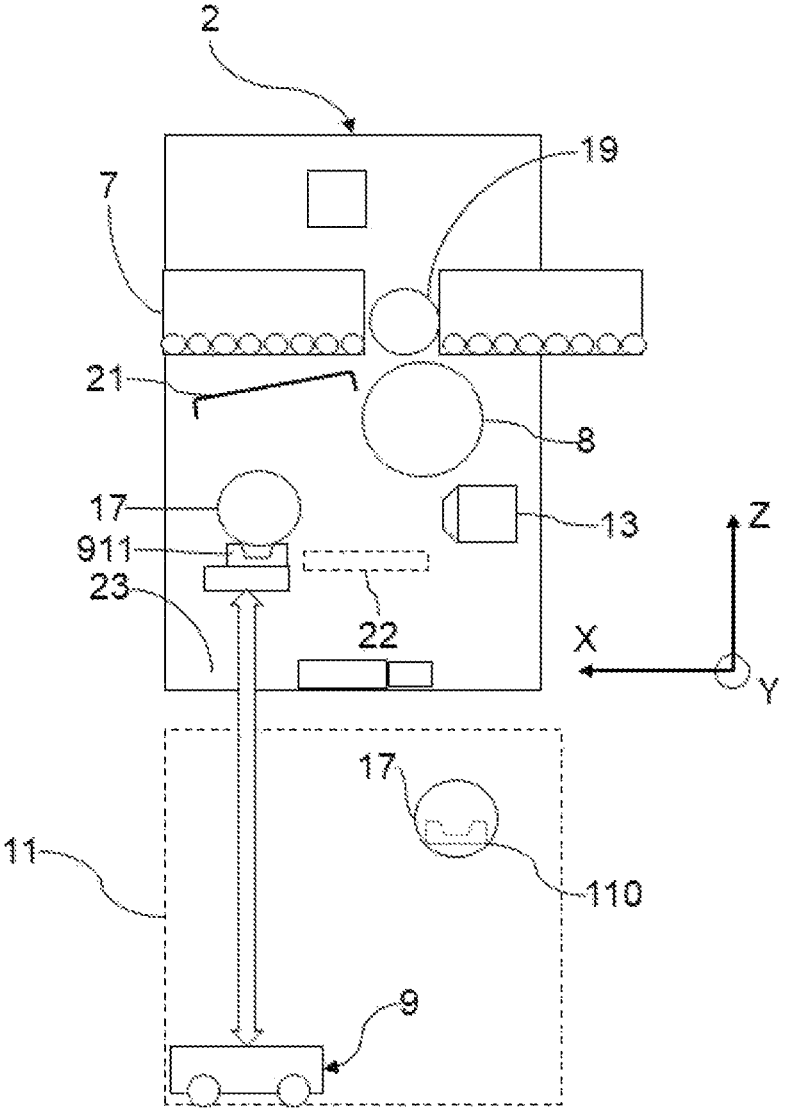

[Fig. 10]
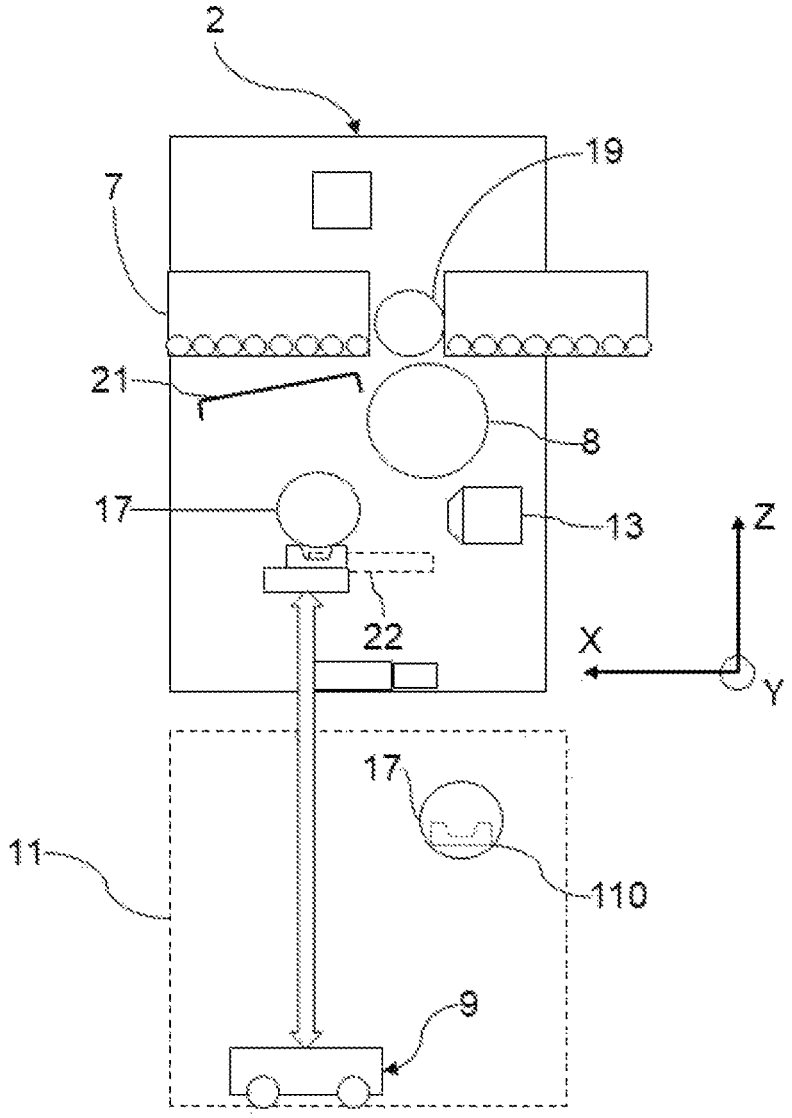

[Fig. 11]
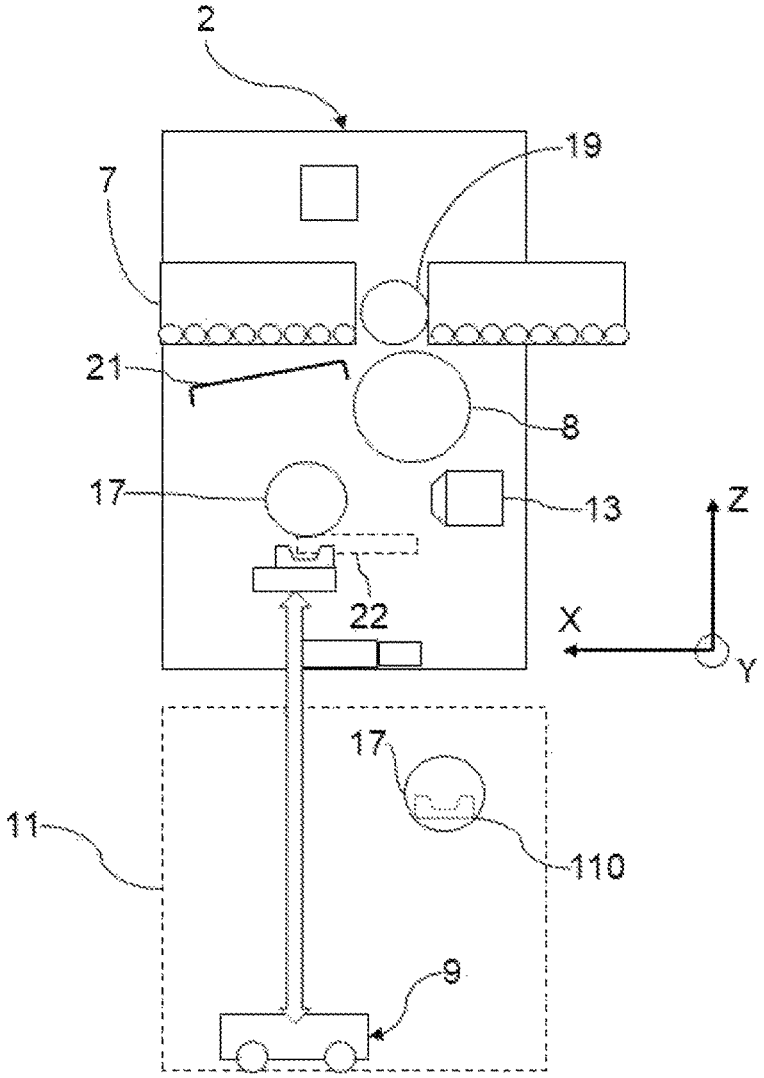
[Fig. 12]
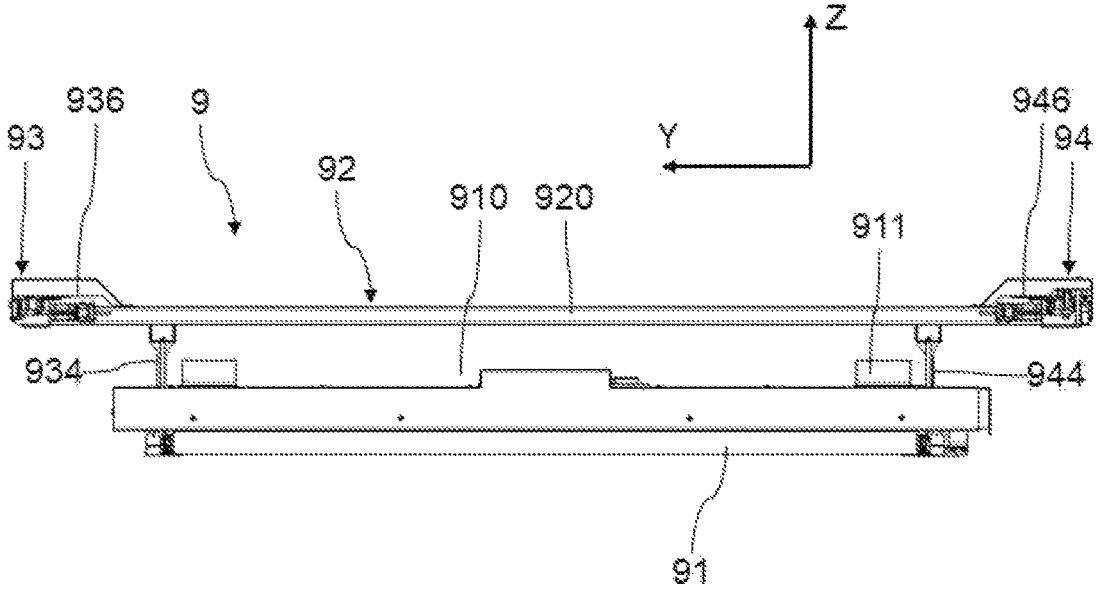

[Fig. 13]
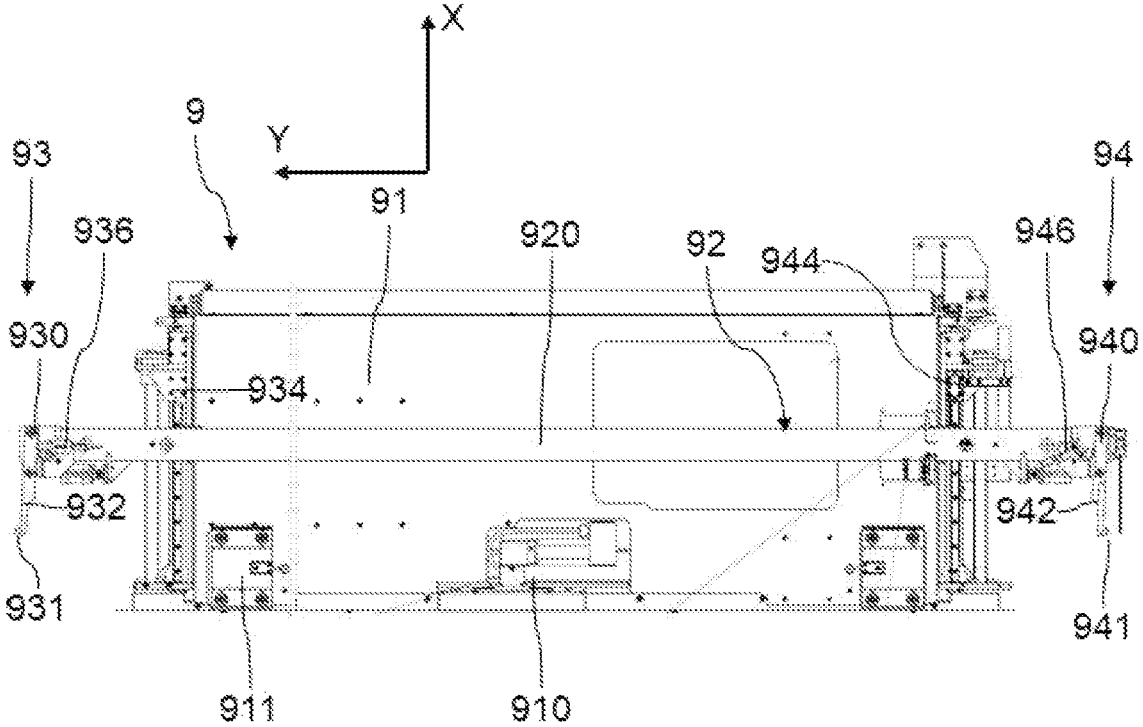
[Fig. 14]
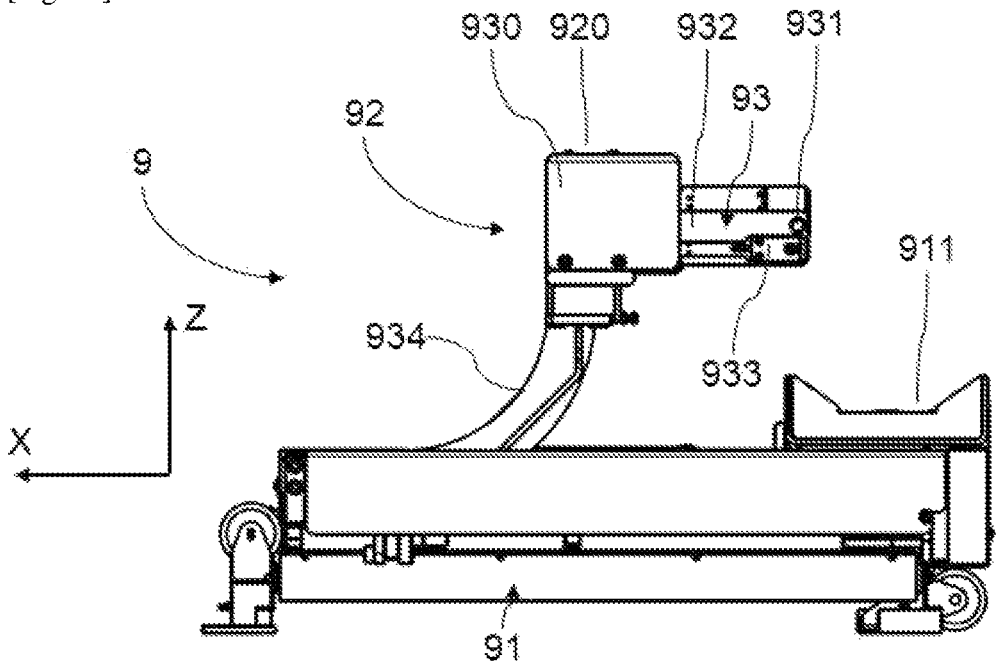

[Fig. 15]
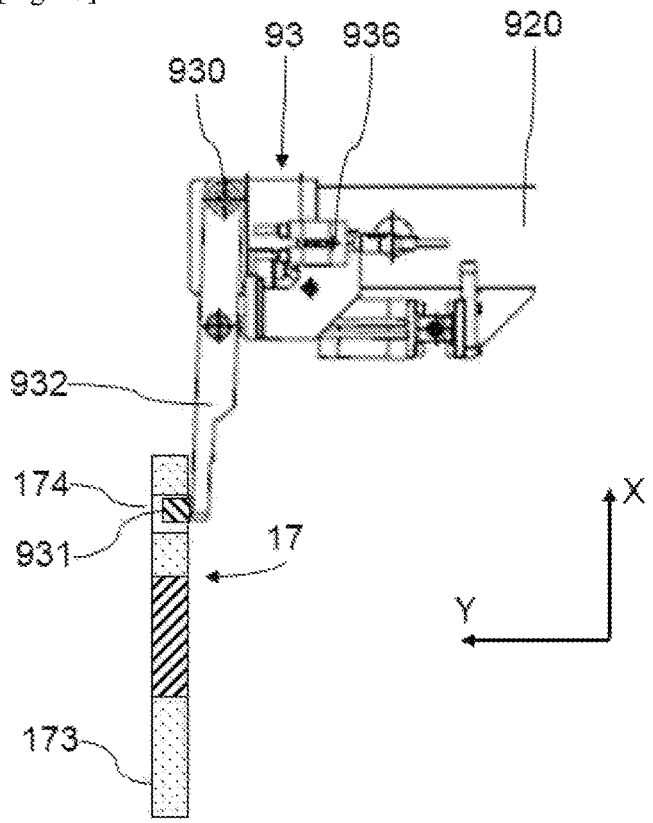
[Fig. 16]
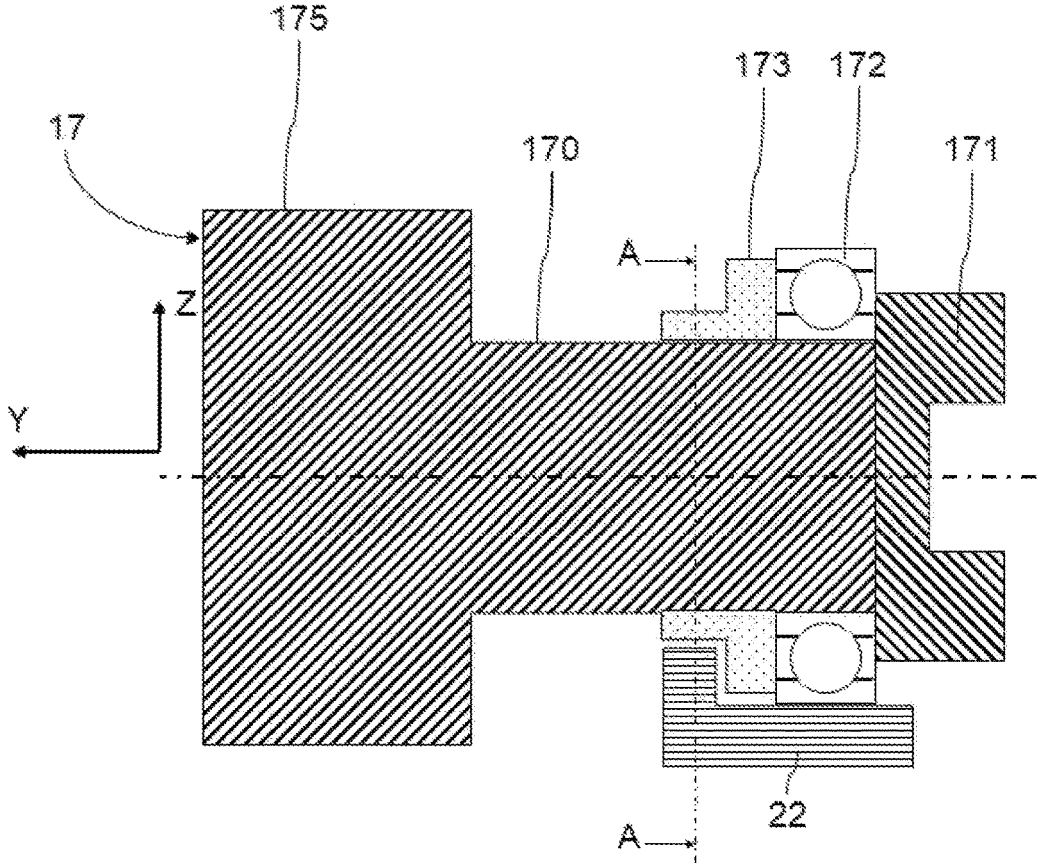

[Fig. 17]
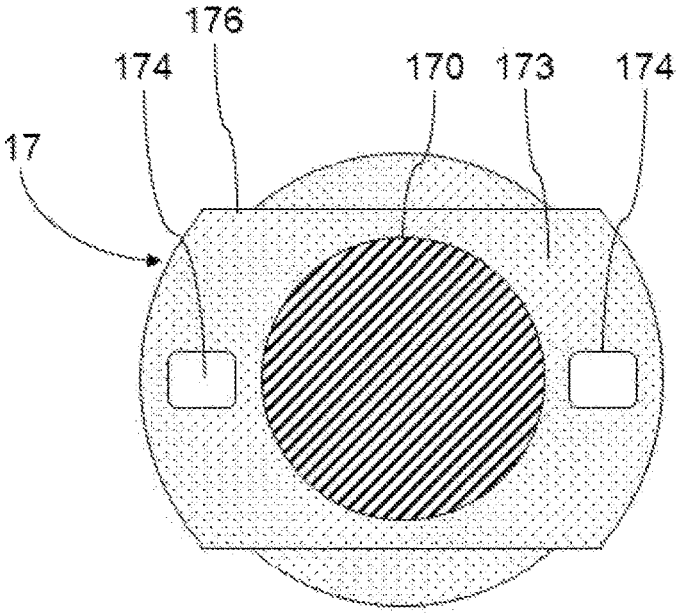
[Fig. 18]
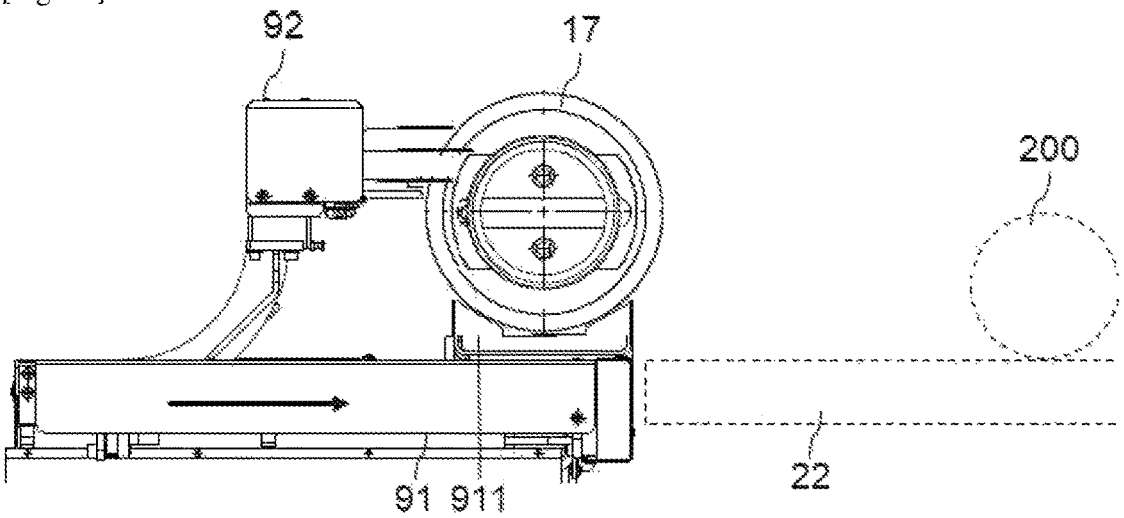
[Fig. 19]
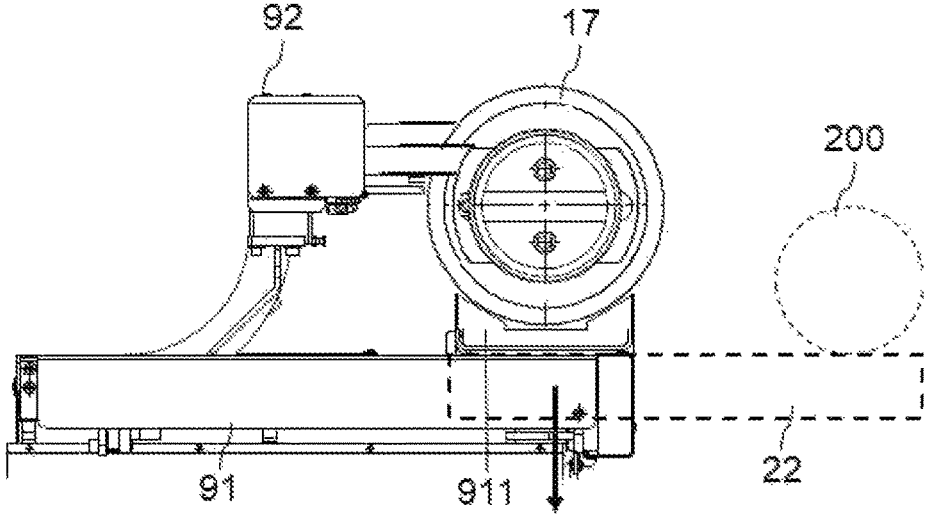

[Fig. 20]
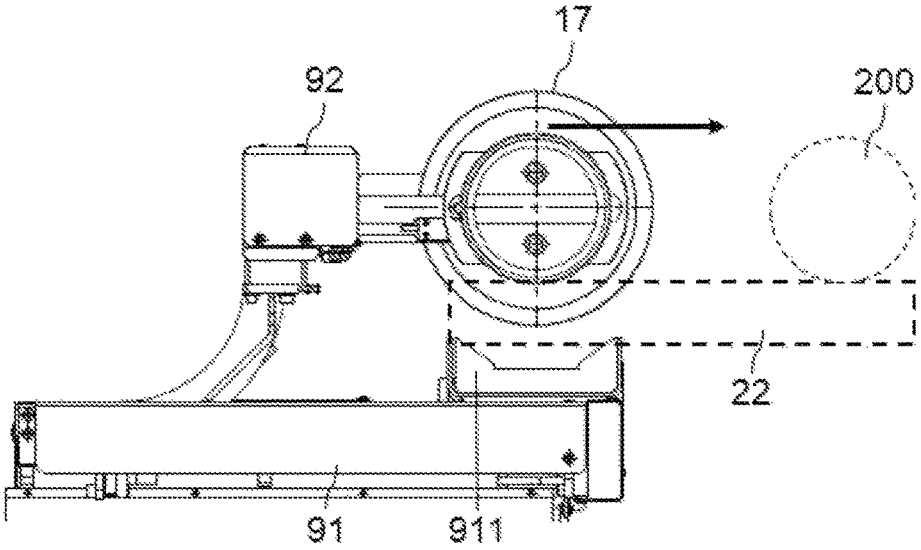
[Fig. 21]
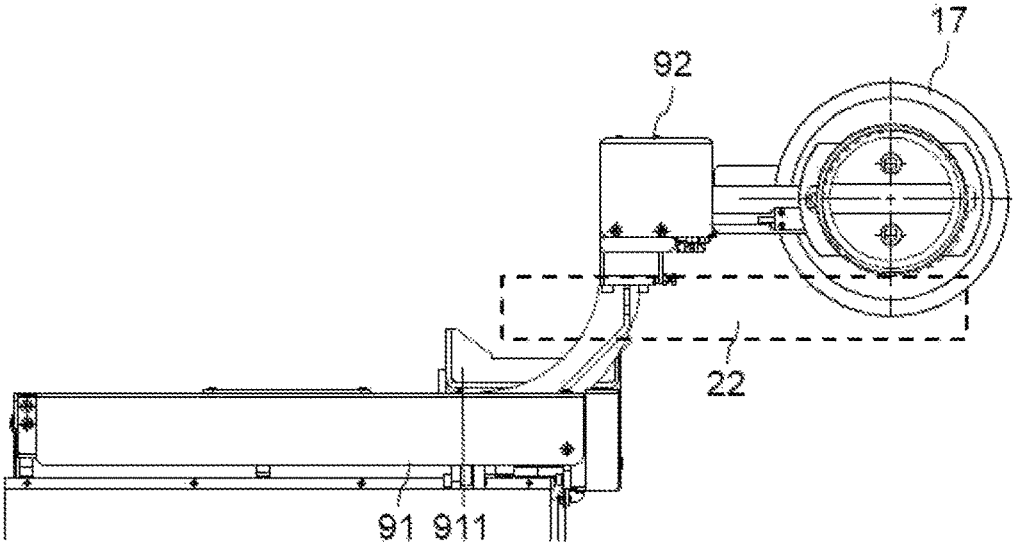
[Fig. 22]
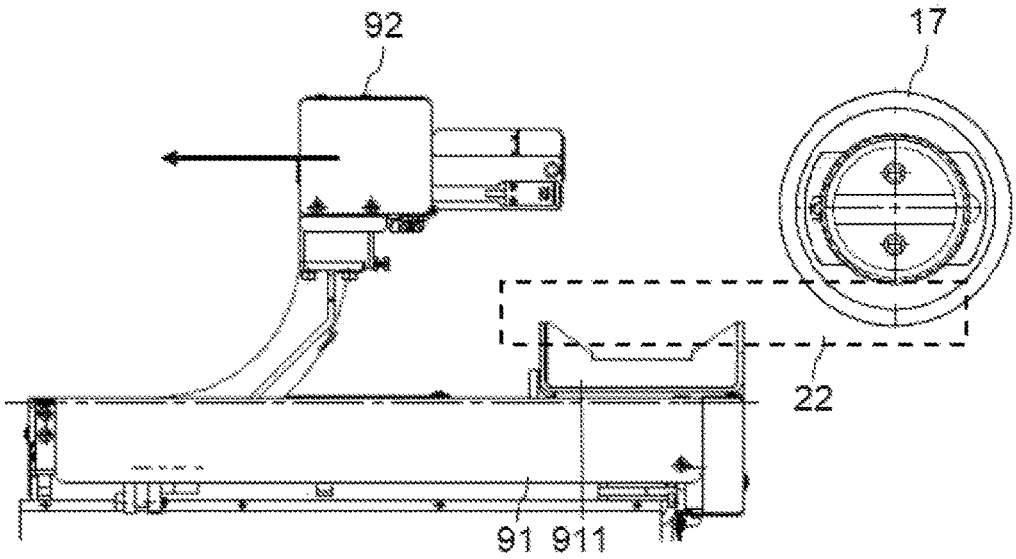

HANDLING CARRIAGE FOR THE CYLINDER OF A PRINTING UNIT IN A PRINTING MACHINE

CROSS-REFERENCE TO RELATED APPLICATION(S)

This application is a National Stage under 35 U.S.C. § 371 of International Application No. PCT/EP2020/025078, filed on Feb. 19, 2020, which claims priority to French Patent Application No. 1901692, filed on Feb. 20, 2019, the contents of all of which are incorporated by reference in their entirety.

The invention relates to printing machines and, in particular, to the methods for changing over rolls in printing units of printing machines and to the carriages intended to carry out this changeover.

The invention also relates to a roll of a printing unit in a printing machine, configured to be handled by such a carriage.

A flexographic printing machine is used in the packaging industry to print a medium of the continuous strip or sheet element type, such as a sheet of cardboard. The machine comprises several successive printing units, which are positioned one after another, each of the printing units printing in a different colour.

A printing unit notably comprises a plate cylinder, around which a flexible plate with raised patterns is wound and tightly held. The plate cylinder prints the patterns directly by contact in the one same colour for each of its rotations. The printing plate prints the sheet after having been coated with ink, thanks to a screen roller, equipped with cells, known as the anilox roll, and an inking device, equipped with a doctor blade chamber, with an ink chamber, and with at least one pump.

The anilox roll has, on its circumferential surface, cells intended to hold the ink that is to be applied to the printing plate of the plate cylinder. The volume of these cells varies according to the work that is to be carried out. Thus, it is necessary to plan for the use of different anilox rolls for each specific job of work that is to be carried out. By way of example, an anilox roll used for a print run comprising full-tone regions, namely large areas that are uniformly coated with ink, is not suitable for finer printwork that does not comprise significant full-tone regions. That means changing over these anilox rolls according to the quality of printing that is to be achieved on the medium.

PRIOR ART

Document EP1464490 describes a method and a device for loading and changing over the rolls of the printing units of a printing machine.

One first disadvantage is that an operator has to get in between the printing units in order to perform the anilox roll changeover, and this requires him to pay particular attention as to his safety.

Another disadvantage lies in the relatively long time that it takes to perform the anilox roll changeover operation, which takes the machine out of operation for that length of time, thus reducing its productivity.

An additional disadvantage is that the roll changeover requires the intervention of two operators.

SUMMARY OF THE INVENTION

The invention seeks to solve one or more of these disadvantages. The invention thus relates to a mobile handling carriage for a rotary roll in a printing unit of a printing machine, comprising:

- a chassis mobile in a horizontal plane configured to be driven in motion in a longitudinal direction of travel of sheet elements in the printing machine;
- a support member mounted on the chassis, configured to support and hold the roll so that its axis of rotation is oriented in a transverse direction perpendicular, in a horizontal plane, to the longitudinal direction;
- a first drive device configured to drive the support member in translation with respect to the chassis in a vertical direction perpendicular to the transverse direction;
- an actuator mounted on the support member and configured to collaborate with the roll positioned a distance above the support member;
- a second drive device configured to drive the actuator in translation with respect to the support member, in the longitudinal direction perpendicular to the vertical and transverse directions;
- a control circuit configured to control a first sequence including successively:
- a raising of the support member;
- a longitudinal translation of the support member in a first direction;
- a lowering of the support member;
- a longitudinal translation of the actuator in the first direction.

The invention also relates to the following variants. A person skilled in the art will appreciate that each of the features in the following variants can be combined independently with the features above, without thereby constituting an intermediate generalization.

According to one variant, the control circuit is configured to control a second sequence including successively:

- a longitudinal translation of the actuator in a second direction opposite to the first;
- a raising of the support member;
- a longitudinal translation of the support member in the second direction;
- a lowering of the support member.

According to another variant, the actuator comprises first and second gripping members positioned at first and second transverse ends of the actuator, the first and second gripping members being able to move with respect to the support member in the longitudinal direction, the first and second gripping members each having one end able to move in the transverse direction.

According to another variant, the first and second gripping members each comprise an arm pivot mounted about a vertical axis.

According to another variant, the first and second gripping members each comprise a lug at their mobile end, the lug projecting with respect to its gripping member in the transverse direction.

According to one variant, the actuator comprises an optical sensor configured to determine the presence of an object in the vicinity of the mobile end of the first gripping member or of the second gripping member.

According to another variant, the support member comprises at least one longitudinal guide rail, and the actuator is mounted with the ability to slide on the guide rail.

According to another variant, the first and second gripping members are mounted on the one same crossmember mounted with the ability to slide on the rail and driven in translational by the second drive device.

According to another variant, the support member is mounted on the chassis via a pantograph mechanism.

The invention also relates to a printing machine comprising:

a mobile carriage as defined hereinabove;

a rotary roll;

a printing unit of a printing machine comprising two slides spaced apart in a transverse direction, the two slides coming to interfere with the rotary roll held on the support member during the lowering of the support member during the first sequence.

The invention also relates to a rotary roll for a printing unit, comprising:

a middle part intended to hold ink;

first and second flanges fixed one on each side of the middle part, the flanges comprising a bore which is off-axis with respect to the axis of rotation of the rotary roll.

According to a variant, the roll comprises a flat parallel to the axis of rotation of the rotary roll.

According to another variant, the first and second flanges are made of steel.

According to yet another variant, the roll comprises a set of cells intended to hold ink.

BRIEF DESCRIPTION OF THE DRAWINGS

Further features and advantages of the invention will become clearly apparent from the following description thereof given hereinafter by way of entirely nonlimiting indication, with reference to the attached drawings in which:

FIG. 1 is a side view of a flexographic printing machine;

FIG. 2 is a side view of a printing unit of the printing machine of FIG. 1 associated with a roll handling carriage;

FIG. 3 is a perspective partial view of the bottom part of the printing machine of FIG. 1 associated with a handling carriage;

FIG. 4 is a perspective partial view of a handling carriage according to one embodiment of the invention, in the deployed position;

FIG. 5 is a perspective view of a handling carriage according to one embodiment of the invention, in the retracted position;

FIG. 6 is a perspective view of a support member of the handling carriage of FIG. 5;

FIG. 7,

FIG. 8,

FIG. 9,

FIG. 10 and

FIG. 11 are schematic side views of the handling of a roll by a support member of a carriage at various phases of a process of loading the roll in a printing unit;

FIG. 12 is a rear view of the top part of a carriage according to one embodiment of the invention;

FIG. 13 is a view of the carriage of FIG. 12, from above;

FIG. 14 is a view in lateral section of the carriage of FIG. 12 detailing an actuator;

FIG. 15 is a view of an actuating arm of the carriage of FIG. 12, from above, in the gripping position;

FIG. 16 is a partial sectional view of a roll resting on a slide of a printing unit;

FIG. 17 is a side view of the roll of FIG. 16, in section through a flange;

FIG. 18,

FIG. 19,

FIG. 20,

FIG. 21 and

FIG. 22 are side views of various positions of an actuator and of a support member at various stages in the installation of a roll in a printing unit.

The direction X is a longitudinal direction and is defined with reference to the direction of travel or of driving of sheet elements through the printing machine, along their central longitudinal axis. The direction Y is a transverse direction and is defined as being the direction perpendicular, in a horizontal plane, to the direction of travel of the sheet elements. The direction Z is a vertical direction, perpendicular to the transverse direction Y. The upstream and downstream directions are defined with reference to the direction of travel of the sheet elements, in the longitudinal direction through the entirety of the printing machine, from entering the machine to the machine exit.

DETAILED DESCRIPTION OF PREFERRED EMBODIMENTS

As depicted in FIG. 1, a flexographic printing machine 100 comprises a feeding station 1 followed by printing stations or printing units positioned one after the other 2, 3, 4, 5, 6. Sheet elements, such as sheets 102 that are to be printed, are transported in the longitudinal direction X and in the board direction of travel (arrow F) through these various stations using suction conveyors 7.

FIG. 2 is a schematic depiction of a printing unit 2 (the printing units 3 to 6 here being identical). The printing unit 2 comprises a form cylinder 8, an impression cylinder 19, a screen roller 10 known as an anilox roll and a doctor blade chamber 13. The form cylinder 8, the impression cylinder 19, the screen roller 10 and the doctor blade chamber 13 collaborate with one another. The printing unit 2 comprises a reserve station 11 for anilox rolls 17 in the bottom part of the printing machine 100. The printing machine 100 comprises a handling carriage 9 for handling the anilox rolls 17.

FIG. 3 is a perspective partial view of the bottom part of the printing machine 100. The reserve station 11 comprises supports 110 intended to support the ends of the anilox rolls 17. A storage station 14 is also created in the lower part of the feeding station 1. This storage station 14 may have spaces for three anilox rolls 17. This storage station 14 in this instance comprises two reserve stations next to each other and equipped with supports 110 analogous to those of the printing units 2 to 6.

The carriage 9 for handling anilox rolls is common to the printing units 2 to 6 and to the feeding station 1. The carriage 9 is mobile in a horizontal plane. The carriage 9 is notably configured to pass through the reserve stations 11 of the various printing units 2 to 6. The carriage 9 in this instance is guided in translational movement in the longitudinal direction by a guidance system 103. The guidance system 103 comprises rails or runway tracks 104 extending in the longitudinal direction.

FIG. 4 is a perspective view of the bottom part of a carriage 9 for handling anilox rolls 10 or 17. The carriage 9 comprises a chassis 90 in its lower part. The chassis 90 is mobile in a horizontal plane including the longitudinal direction. The chassis 90 moves in the longitudinal direction driven by a motor 900. The chassis 90 comprises a safety device 901, fitted with bumpers front and rear, pressure against these bumpers being able to cause the carriage 9 to effect an emergency stop.

A support member 91 is mounted on the chassis 90. The support member 91 here takes the overall form of a plate. The support member 91 is configured to support and hold a roll 10 in such a way that the axis of rotation of this roll is oriented in the transverse direction Y. The support member 91 here comprises bearing surfaces 911, positioned at its transverse ends. The bearing surfaces 911 here have U-shaped recesses so as to be able to hold a roll 10 stably with its axis of rotation oriented in the transverse direction Y. A drive device 902 is configured to drive the support member 91 in translation with respect to the chassis 90 in the vertical direction. The drive device 902 thus allows the support member 91 to be kept either in the retracted position or in various deployed positions. The retracted position of the support 91 notably allows the carriage 9 to be moved in under the printing units 2 to 6. The deployed positions notably allow a roll 10 to be handled in the reserve stations 11 or within the printing units 2 to 6. Such a drive device 902 has a structure, for example based on a geared motor unit and a transmission using chains plus a ball nut and screw.

In order to be able to have a small vertical bulk when the support member 91 is retracted, the support member 91 here is advantageously mounted on the chassis 90 via a pantograph mechanism 903. The pantograph mechanism 903 thus comprises two criss-crossing slides supporting the support member 91.

The carriage 9 further comprises an actuator 92, not illustrated in FIG. 4 for the sake of clarity. FIG. 5 is a perspective view of the carriage 9 equipped with an actuator 92. FIG. 6 is a perspective view of the support member 91 equipped with the actuator 92, seen from a different angle. As detailed hereinafter, the actuator 92 is mounted on the support member 91. The actuator 92 is configured to collaborate with a roll 10 when this roll is positioned a distance above the support member 91, as detailed hereinafter. A drive device 910 is configured to drive the actuator 92 in translation with respect to the support member 91, in the longitudinal direction X.

A control circuit, not illustrated, is configured to control the movements of the mobile chassis 90 and the movements of the support member 91. The control circuit is also configured to control the actuator 92.

FIGS. 7 to 11 are schematic side views of the handling of a roll 17 involving the chassis 90 and the support member 91 during initial steps of loading this roll 17 into the print unit 2. The later steps of loading the roll 10 into the printing unit 2, involving the actuator 92, will be detailed later on.

In the configuration illustrated in FIG. 7, rolls 17 rest on supports 110 of a reserve station 11 positioned under the printing unit 2. This sequence may correspond to an anilox roll changeover. An anilox roll changeover is required for example when there is a change in work necessitating the use of an anilox roll 17 having a cell configuration that is more suitable than the configuration of the cells of the previous anilox roll for performing this new job of work. In the configuration illustrated in FIG. 7, one anilox roll 10 has already been withdrawn from the printing unit 2.

In the configuration illustrated in FIG. 8, the carriage 9 is positioned in the longitudinal direction in such a way that the bearing surfaces 911 are positioned underneath one of the rolls 17. The drive device 902 then raises the support member 91 until the bearing surfaces 911 come into contact with the roll 17 then lift this roll 17 above its support 110.

In the configuration illustrated in FIG. 9, the carriage 9 is moved in the longitudinal direction X to place the roll 17 present on the bearing surfaces 911 in vertical alignment with the space 23 available between two printing units 2 and 3. A protective cover 21 is opened, in order to give access for placing the roll 17 opposite the cylinder 8 and the doctor blade chamber 13. Such a protective cover 21 is notably provided to prevent splashes of ink while the machine 100 is running. An operator can thus get inside the printing unit 2 while the machine 100 is running. The drive device 902 then raises the support member 91 until the roll 17 is positioned above the slides 22. The slides 22 take for example the form of rails oriented in the longitudinal direction X and positioned with a transverse spacing that corresponds more or less to the length of the roll 17.

In the configuration illustrated in FIG. 10, the carriage 9 is moved in the longitudinal direction X to place the roll 17 with its ends in vertical alignment with the slides 22.

In the configuration illustrated in FIG. 11, the drive device 902 then lowers the support member 91 again until the roll 17 comes to rest via its ends on the slides 22 and until contact between the bearing surfaces 911 and this roll 17 is broken.

FIG. 12 is a rear view of the top part of the carriage 9 according to one embodiment of the invention. More specifically, FIG. 12 illustrates the actuator 92 and the support member 91 on which the actuator 92 is mounted. FIG. 13 is a view from above of the top part of the carriage 9. FIG. 14 is a view in section of the carriage 9 from the side, detailing part of the actuator 92.

The actuator 92 here comprises gripping members 93 and 94 positioned at transverse ends of the actuator 92. The gripping members 93 and 94 are able to move with respect to the support member 91 in the longitudinal direction. The gripping members 93 and 94 are mounted here with the ability to slide with respect to the support member 91 in the longitudinal direction. The gripping members 93 and 94 may for example be mounted with the ability to slide on respective guide rails (not illustrated) of the support member 91.

The drive device 910 drives the gripping members 93 and 94 in sliding in the longitudinal direction. The gripping members 93 and 94 are driven in longitudinal sliding by respective ball nut and screw drive mechanisms. Ball nut and screw mechanisms notably allow the actuator 92 to be driven with a mechanism that is small in bulk. The gripping members 93 and 94 notably comprise vertical uprights 934 and 944 respectively. The gripping members 93 and 94 are guided in longitudinal sliding with respect to the support member 91 by these vertical uprights 934 and 944. As best illustrated in FIG. 14, the vertical uprights are hollowed in their downstream part, to make it easier for the actuator 92 to pass between the rolls 17 present in a reserve station 11.

The gripping members 93 and 94 comprise respective lugs 931 and 941. These lugs 931 and 941 are positioned at an upstream longitudinal end of the gripping members 93 and 94. The upstream longitudinal end of the gripping members 93 and 94 is able here to move in the transverse direction with respect to the support member 91. In this embodiment, the gripping members 93 and 94 respectively comprise arms 932 and 942. The lugs 931 and 941 project transversely outwards with respect to the arms 932 and 942 respectively.

These arms 932 and 942 are mounted with the ability to pivot about vertical axes 930 and 940 respectively. A pivoting of the arms 932 and 942 thus makes it possible to alter the transverse position of the lugs 931 and 941 respectively. The pivoting of the arms 932 and 942 is performed by respective actuating cylinders 936 and 946 controlled by the control circuit.

The axes 930 and 940 here are fixed to a crossmember 920. The crossmember 920 extends in a transverse direction and connects the upper ends of the uprights 934 and 944. Such a crossmember 920 makes it possible to stiffen the actuator 92. In this instance, the arms 932 and 942 are transversely cantilevered with respect to the upright 934 and 944 respectively. Such a crossmember 920 thus allows the actuator 92 to be stiffened in the face of pivot torques applied to the arms 932 and 942.

In the example illustrated, the actuator 92 is equipped with at least one sensor to determine the presence of an object in the vicinity of the ends of the arms 932 and 942. In the example, the actuator 92 comprises inductive sensors to determine the presence of a flange of a roll 17 near the lugs 931 and 941. An inductive sensor 933 is notably attached to the end of the arm 932, and an inductive sensor 943 is notably fixed on the end of the arm 942.

FIG. 15 illustrates the gripping member 93 engaged with a flange 173 of a roll 17. In this configuration, the arm 932 is pivoted in such a way as to introduce the lug 931 into a bore 174 of the flange 173. The bore 174 is off-axis with respect to the axis of rotation of the roll 17. The introduction of the lug 931 into the bore 174 does not disrupt the subsequent grasping of the rolling bearing 172 by a disengageable bearing mount of the printing unit.

An example of a roll 17 that is configured to collaborate with the actuator 92 is illustrated with reference to FIGS. 16 and 17. FIG. 16 is a view in partial section of such a roll 17. The roll 17 comprises an anchoring surface 175 in its central part. The roll 17 comprises a bearing surface 170 at each of its transverse ends (the transverse direction corresponds here to the direction Y detailed beforehand, namely the axis of rotation of the roll 17). A coupling piece 171 is fixed to the end of the bearing surface 170. The coupling piece 171 allows the printing unit to drive the roll 17 in rotation. A rolling bearing 172 is push-fitted onto the bearing surface 170. The rolling bearing 172 is used to guide the rotation of the roll 17 with respect to the printing unit. Such a disengageable bearing (not illustrated) of the printing unit is thus configured to grip around a peripheral surface of the rolling bearing 172. The roll 17 is also configured so that it can run on slides 22, resting on rolling bearings 172. The roll 17 may thus be guided in sliding in the longitudinal direction, by contact between the slides 22 and the rolling bearings 172.

The flange 173 is fixed here to the bearing surface 170. The configuration of the flange 173 is better illustrated here in FIG. 17. At least one bore 174, in this case two opposing bores 174, made in the flange 173, allow the lug 931 to engage selectively with the flange 173. When the lug 931 is engaged with the flange 17, the gripping member 93 can drive the roll 17 in translation in the longitudinal direction. Of course, the lug 941 may selectively come into engagement with a similar flange at the other transverse end of the roll 17. The inductive sensors that may potentially be positioned at the ends of the arms 932 and 942 notably allow the control circuit to determine whether or not the lugs 931 and 941 are engaged with the flanges 173 of a roll 17.

The flange 173 here comprises flats 176, which allow the slide 22 to guide this flange 173 in sliding in the longitudinal direction. The flats 176 allow the bores 174 to be kept always in the same orientation during the translational movement of the roll 17 on the slides 22 for the locking of the lugs 931 and 941 and for inserting the roll 17 into the machine in the working position (200).

FIGS. 18 to 22 are side views of various positions of the actuator 92 and of the support member 91 at various stages in the installation of a roll 17 in a printing unit.

In the configuration illustrated in FIG. 18, the roll 17 is resting on the bearing surfaces 911 of the support member 91. The control circuit has previously commanded a raising of the support member 91, which means that the support member 91 is positioned substantially at the same height as the slides 22 of a printing unit. The gripping members 93 and 94 are kept in a retracted position so as not to interfere with the flanges of the roll 17. The position of a bearing for driving the rotation of the roll 17 by the printing unit is illustrated by the circle 200. This bearing 200 is positioned in a position upstream of the support member 91. The control circuit is configured to control the movement of the support member 91 longitudinally with respect to the printing unit in the upstream direction.

In the configuration illustrated in FIG. 19, the support member 91 has conveyed the roll 17 into a position in which its ends are positioned in vertical alignment with the slides 22, with a separation from the slides 22. The roll 17 is therefore still supported by the bearing surfaces 911. The control circuit then commands a lowering of the support member 91.

The lowering of the support member 91 is continued until the roll 17 is supported at its ends by the slides 22, as illustrated in FIG. 20. The lowering of the support member 91 is performed in such a way that the lugs 931 and 941 of the gripping members 93 and 94 are positioned level with the bores 174 of the flanges 173. Moreover, the gripping members 93 and 94 are moved longitudinally in such a way as to position the lugs 931 and 941 so that they face the bores 174 of the flanges 173 (optical sensors may be employed in order to ensure accurate longitudinal positioning of the lugs 931 and 941 with respect to the bores 174, by longitudinal movement of the actuator 92). The control circuit then commands the transition of the gripping members 93 and 94 into the deployed or locking position. Lugs 931 and 941 therefore engage in the bores 174 of the flanges 173. The control circuit is then configured to command the actuator 92 to drive the roll 17 in sliding in the upstream direction. The actuator 92 thus slides in the upstream direction with respect to the support member 91.

The sliding of the roll 17 on the slides 22 is continued until the bearing surfaces of the roll 17 are positioned level with the bearings 200 of the printing unit, as illustrated in FIG. 21. When the printing unit determines that the roll 17 is in position, the bearings 200 may lock around the rolling bearings 172 of the roll 17.

The control circuit is configured to implement a reverse order of operations in order to offload the roll 17 from the printing unit.

The actuator 92 according to the invention thus allows a roll to be loaded into or offloaded from a printing unit automatically. Such handling by the actuator 92 makes it possible to limit operator interventions in the printing unit and makes it possible to reduce the cycle time for loading or offloading the roll. Furthermore, the configuration of the actuator 92 which is illustrated proves to be particularly compact, encouraging it to move in the longitudinal direction in the small space available in the printing unit. Longitudinal movements of the actuator 92 may actually be achieved while keeping the support member 91 immobile. The actuator 92 may thus proceed with handlings of rolls, in locations that the support member 91 would be unable to access because of its bulkiness.

In the embodiment illustrated, the actuator 92 further comprises a guidance system and a drive mechanism at each end of the roll 17, making it possible to achieve linear translational movement without the risk of offset between the left side and the right side as might happen in the case of it being shifted manually by two operators.

Various examples of roll loading/offloading scenarios may be performed using a carriage 9 according to the invention. For example, the carriage 9 may be commanded to replace a roll in the process of being used in a printing unit with another roll stored in a storage station. In order to do that, the control circuit may command the carriage 9 to perform the following sequence:

to collect a roll initially in place in the printing unit;

to place the collected roll in an empty space of a storage station 11;

to collect another roll stored in a space of the storage station 11;

to load this other roll into the printing unit;

to restart the printing unit printing cycle using this other roll.

The carriage 9 may be operated according to this scenario to change the rolls of one or more printing units during the one same shutdown of the printing cycle.

According to another example of a scenario, the carriage 9 may be commanded to switch a roll in the working position in one printing unit with another roll in the working position in another printing unit. In order to do that, the control circuit may command the carriage 9 to perform the following sequence:

to collect a first roll initially in place in a first printing unit;

to place the first roll collected in an empty space of a storage station 11;

to collect a second roll initially in place in a second printing unit;

to load this second roll into the first printing unit;

to collect the first roll from the storage station 11;

to load this first roll into the second printing unit;

to restart the printing unit printing cycle.

According to another example of a scenario, the carriage 9 may be commanded to perform the cleaning of a roll initially in the process of being used in a printing unit. In order to do that, the control circuit may command the carriage 9 to perform the following sequence:

to collect the roll initially in the process of being used in the printing unit;

to place the roll in a washing station;

to proceed to wash the roll in the washing station.

The invention claimed is:

1. A mobile handling carriage for a rotary roll in a printing unit of a printing machine, the mobile handling carriage comprising:

a chassis configured to be mobile in a horizontal plane and driven in motion in a longitudinal direction of travel of sheet elements in the printing machine;

a support member mounted on the chassis, the support member being configured to support and hold the rotary roll so that an axis of rotation of the rotary roll is oriented in a transverse direction, the transverse direction being perpendicular, in the horizontal plane, to the longitudinal direction;

a first drive device configured to drive the support member in translation with respect to the chassis in a vertical direction;

an actuator mounted on the support member and configured to collaborate with the rotary roll positioned a distance above the support member;

a second drive device configured to drive the actuator in translation with respect to the support member, in the longitudinal direction; and a control circuit configured to control a first sequence including successively:

a raising of the support member;

a longitudinal translation of the support member in a first direction;

a lowering of the support member; and a longitudinal translation of the actuator in the first direction, wherein the actuator comprises first and second gripping members positioned at first and second transverse ends of the actuator, the first and second gripping members being able to move with respect to the support member in the longitudinal direction, the first and second gripping members each having one end able to move in the transverse direction.

2. The mobile handling carriage of claim 1, wherein the control circuit is further configured to control a second sequence including successively:

a longitudinal translation of the actuator in a second direction opposite to the first direction;

a raising of the support member;

a longitudinal translation of the support member in the second direction; and a lowering of the support member.

3. The mobile handling carriage of claim 1, wherein the first and second gripping members each comprise an arm pivot mounted about a vertical axis.

4. The mobile handling carriage of claim 1, wherein the first and second gripping members each comprise a lug at a mobile end of the first and second gripping members, the lug projecting with respect to a respective gripping member of the first and second gripping members in the transverse direction.

5. The mobile handling carriage of claim 1, wherein the actuator further comprises an optical sensor configured to adjust a stroke of the actuator with respect to a position of the rotary roll.

6. The mobile handling carriage of claim 1, wherein the rotary roll is an anilox roll.

7. The mobile handling carriage of claim 1, wherein the chassis is configured to be guided by a guidance system.

8. The mobile handling carriage of claim 7, wherein the guidance system comprises runway tracks extending in the longitudinal direction.

9. A printing machine comprising:

a mobile handling carriage as claimed in claim 1;

a rotary roll; and a printing unit comprising two slides spaced apart in the transverse direction, the two slides coming to interfere with the rotary roll held on the support member during the lowering of the support member during the first sequence.

10. A mobile handling carriage for a rotary roll in a printing unit of a printing machine, the mobile handling carriage comprising:

a chassis configured to be mobile in a horizontal plane and driven in motion in a longitudinal direction of travel of sheet elements in the printing machine;

a support member mounted on the chassis via a pantograph mechanism, the support member being configured to support and hold the rotary roll so that an axis of rotation of the rotary roll is oriented in a transverse direction, the transverse direction being perpendicular, in the horizontal plane, to the longitudinal direction;

a first drive device configured to drive the support member in translation with respect to the chassis in a vertical direction;

an actuator mounted on the support member and configured to collaborate with the rotary roll positioned a distance above the support member;

a second drive device configured to drive the actuator in translation with respect to the support member, in the longitudinal direction; and a control circuit configured to control a first sequence including successively:

a raising of the support member;

a longitudinal translation of the support member in a first direction;

a lowering of the support member; and a longitudinal translation of the actuator in the first direction.

11. The mobile handling carriage of claim 10, wherein the control circuit is further configured to control a second sequence including successively:

a longitudinal translation of the actuator in a second direction opposite to the first direction;

a raising of the support member;

a longitudinal translation of the support member in the second direction; and a lowering of the support member.

12. The mobile handling carriage of claim 11, further comprising first and second gripping members, wherein the first and second gripping members each comprise an arm pivot mounted about a vertical axis.

13. A printing machine comprising:

a rotary roll comprising first and second flanges fixed one on each side of the rotary roll, the first and second flanges comprising at least one bore which is off-axis with respect to an axis of rotation of the rotary roll;

a printing unit; and a mobile handling carriage for the rotary roll, the mobile handling carriage comprising:

a chassis configured to be mobile in a horizontal plane and driven in motion in a longitudinal direction of travel of sheet elements in the printing machine;

a support member mounted on the chassis, the support member being configured to support and hold the rotary roll so that an axis of rotation of the rotary roll is oriented in a transverse direction, the transverse direction being perpendicular, in the horizontal plane, to the longitudinal direction;

a first drive device configured to drive the support member in translation with respect to the chassis in a vertical direction;

an actuator mounted on the support member and configured to collaborate with the rotary roll positioned a distance above the support member;

a second drive device configured to drive the actuator in translation with respect to the support member, in the longitudinal direction; and a control circuit configured to control a first sequence including successively:

a raising of the support member;

a longitudinal translation of the support member in a first direction;

a lowering of the support member; and a longitudinal translation of the actuator in the first direction, wherein the printing unit comprises two slides spaced apart in the transverse direction, the two slides coming to interfere with the rotary roll held on the support member during the lowering of the support member during the first sequence.

14. The printing machine of claim 13, the rotary roll further comprising a flat parallel to the axis of rotation of the rotary roll.

15. The printing machine of claim 13, the rotary roll further comprising a set of cells configured to hold ink.

16. The printing machine of claim 13, wherein the actuator further comprises an optical sensor configured to adjust a stroke of the actuator with respect to a position of the rotary roll.

17. The printing machine of claim 13, further comprising a reserve station configured to support ends of a plurality of reserve rotary rolls.

18. The printing machine of claim 13, wherein the rotary roll is an anilox roll.

19. The printing machine of claim 13, further comprising a guidance system for guiding the carriage.

20. The printing machine of claim 19, wherein the guidance system comprises runway tracks extending in the longitudinal direction.

* * * * *